United States Patent [19]

Katsura et al.

[11] Patent Number: 4,501,375

[45] Date of Patent: Feb. 26, 1985

[54] EASILY-OPENABLE HEAT-SEAL LID

[75] Inventors: Tadahiko Katsura, Yokohama; Kazumi Hirota, Tokyo; Hiroshi Ueno, Yokosuka, all of Japan

[73] Assignee: Toyo Seikan Kaisha, Ltd., Tokyo, Japan

[21] Appl. No.: 579,542

[22] Filed: Feb. 13, 1984

[30] Foreign Application Priority Data

Feb. 15, 1983 [JP] Japan ..... 58-21990

[51] Int. Cl.[3] ..... B65D 17/34

[52] U.S. Cl. ..... 220/270; 220/260

[58] Field of Search ..... 220/260, 269–273, 220/359; 156/257

[56] References Cited

U.S. PATENT DOCUMENTS

| | | | |
|---|---|---|---|
| 3,744,669 | 7/1973 | Cospen et al. | 220/270 |
| 3,747,797 | 7/1973 | Gayner et al. | 220/270 |
| 4,267,937 | 5/1981 | Piltz et al. | 220/269 |
| 4,428,494 | 1/1984 | Hirota et al. | 220/270 |

*Primary Examiner*—George T. Hall

*Attorney, Agent, or Firm*—Sherman & Shalloway

[57] ABSTRACT

Disclosed is an easily-openable heat-seal lid for forming a heat-sealed portion with a vessel proper for sealing the vessel proper, which is composed of a laminate comprising at least an inner surface member of a heat-sealable resin, a metal foil and an outer protecting layer, wherein a score defining a portion to be opened is formed at a part of the lid more central than the peripheral portion to be heat-sealed so that the score extends to the midway of the metal foil in the thickness direction from the outer side, a through hole piercing through the lid is formed on the inner side of the score in the vicinity of the opening-initiating portion of the score, a rivet of an opening tab, which is composed of the inner surface member material and a heat-sealable resin, is inserted through the hole to project to the inner surface side of the lid, the top end portion of said projecting of the rivet is expanded in the plane direction to secure the opening tab, the top end portion of the rivet projected on the inner surface side is sealed and engaged with the inner surface member by heat fusion bonding, and one end portion of the opening tab or the peripheral portion of the inner surface side of the rivet is substantially superimposed on the opening-initiating portion of the score.

9 Claims, 12 Drawing Figures

EASILY-OPENABLE HEAT-SEAL LID

BACKGROUND OF THE INVENTION (1) Field of the Invention

The present invention relates to an easily-openable heat-seal lid. More particularly, the present invention relates to a heat-seal lid of the metal foil type having a good easy openability and an excellent sealing property in combination.

(2) Description of the Prior Art

A so-called peelable seal lid is known as a heat-seal lid having both the sealing property and easy openability. This peelable seal lid comprises a flexible substrate such as a metal foil and a layer of a heat sealant formed thereon. A heat sealant which is formed by incorporating a wax, a tackifier and an elastomer into an olefin type resin such as polyethylene so that the seal strength is controlled to an order of 1 Kg/15 mm is used. A peelable seal lid of this type, however, is poor in the sealing reliability in the case where a packaging vessel filled with a content and sealed by this lid is subjected to heat sterilization, and according to Official Notice No. 17 of the Welfare Ministry (enforced on Aug. 1, 1977), it is stipulated that a food vessel which is sealed by heat sealing and sterilized by heating under pressure should have a heat seal strength of at least 2.3 Kg/15 mm.

A heat-seal lid sealed to the vessel with such a high seal strength cannot easily be peeled on the heat-sealed interface by hand, and at the present, opening is ordinarily performed by using a tool such as a knife or a can opener.

A so-called easy-open can lid is known as the lid that can easily be peeled by hand without using any particular tool. This can lid is formed by defining an opening on a can lid formed of an aluminum sheet by a score, forming a rivet on the opening integrally with the can lid and securing a pull ring through this rivet on the opening, and this can lid is double-seamed to a flange of a can body.

Thuis easy-open can lid can resist sterilization by heating under pressure and has an excellent openability, but since an aluminum material is used in a large quantity and the can lid is prepared through complicated, troublesome and severe forming steps, the price of the easy-open can lid is considerably higher than that of the above-mentioned flexible heat-seal lid.

Furthermore, this easy-open can is defective in that a vessel to which the easy-open can lid can be applied is limited to a vessel formed of a material having a high heat resistance. More specifically, when this easy-open can is double-seamed to a plastic cup-shaped vessel prepared by draw forming, it is difficult to obtain sealing having a high reliability, and in this case, under hot filling or retort sterilization conditions, safe sealing becomes more difficult because the flange of the cup-shaped vessel is softened at the high temperature adopted.

As another easily-openable heat-seal lid, there is known a lid prepared by forming an opening in a lid member composed of a laminate including a metal foil, a paper substrate and a plastic film and forming an opening tab of a plastic material integrally with the lid member by injection molding so that the tab covers the opening and adheres closely to the peripheral portion of the opening. The heat-seal lid of this type is defective in that it is very difficult to simultaneously attain a good adhering and sealing property of the tab to the peripheral portion of the opening and a good easy openability of the tab.

SUMMARY OF THE INVENTION

It is therefore a primary object of the present invention to provide an easily-openable heat-seal lid which has a high heat seal strength and a good easy openability in combination and in which a tab can be attached to a lid member assuredly and very easily without reduction of the easy openability and seal reliability.

Another object of the present invention is to provide an easily-openable heat-seal lid in which an opening tab is tightly secured to a lid member formed of a laminate sheet without isolation and at the time of opening, the laminate sheet can be cut very smoothly and beautifully along a predetermined opening line.

Still another object of the present invention is to provide an easily-openable heat-seal lid which can advantageously be used for sealing a vessel to which double seaming is difficult, for example, a plastic vessel or an aluminum foil vessel.

More specifically, in accordance with the present invention, there is provided an easily-openable heat-seal lid for forming a heat-sealed portion with a vessel proper for sealing the vessel proper, which is composed of a laminate comprising at least an inner surface member of a heat-sealable resin, a metal foil and an outer protecting layer, wherein a score defining a portion to be opened is formed at a part of the lid more central than the peripheral portion to be heat-sealed so that the score extends to the midway of the metal foil in the thickness direction from the outer side, a through hole piercing through the lid is formed on the inner side of the score in the vicinity of the opening-initiating portion of the score, a rivet of an opening tab, which is composed of the inner surface member material and a heat-sealable resin, is inserted through the hole to project to the inner surface side of the lid, the top end portion of said projection of the rivet is expanded in the plane direction to secure the opening tab, the top end portion of the rivet projected on the inner surface side is sealed and engaged with the inner surface member by heat fusion bonding, and one end portion of the opening tab or the peripheral portion of the inner surface side of the rivet is substantially superimposed on the opening-initiating portion of the score.

In accordance with a preferred embodiment of the present invention, in an easily-openable heat-seal lid having the above-mentioned structure, the ratio of the sectional area of the through hole to the seal area between the rivet and the inner surface member is adjusted within the range of from 20/1 to 1/20.

DETAILED DESCRIPTION OF THE PREFERRED EMBODIMENTS

The present invention will now be described in detail with reference to embodiments illustrated in the accompanying drawings.

Figure 1:
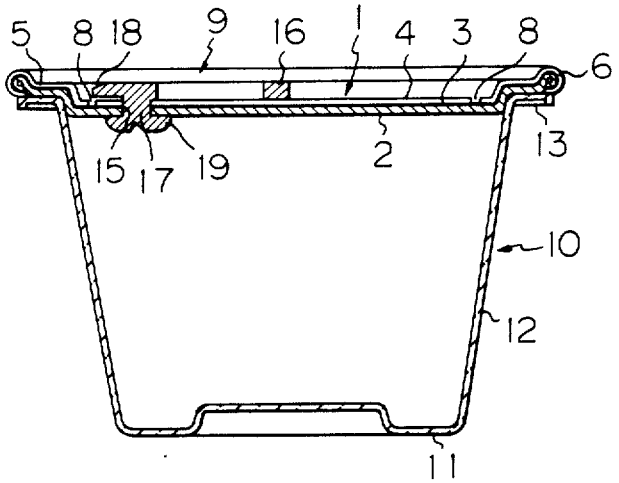
FIG. 1 is a sectional view showing a structure of a vessel according to one embodiment of the present invention.
Figure 2:
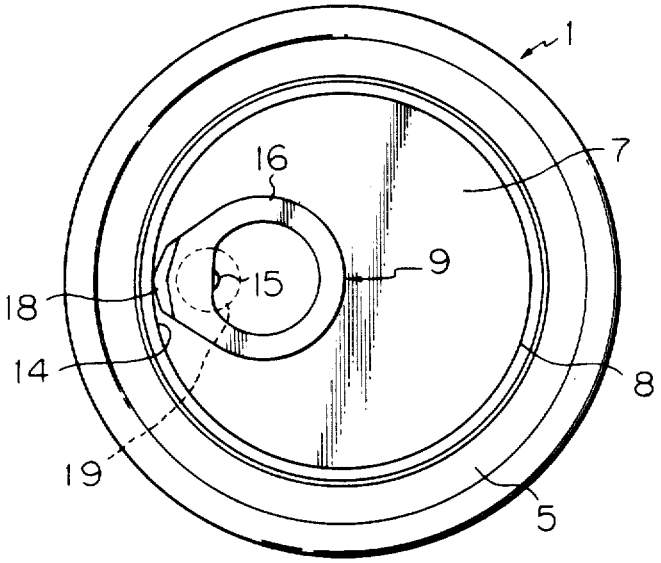
FIG. 2 is a plane view showing a lid of the vessel shown in FIG. 1.
Figure 3:
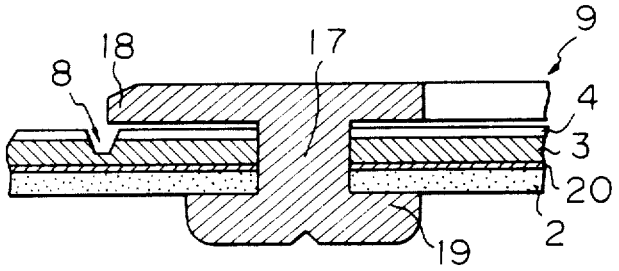
FIG. 3 is an enlarged sectional view of a tab-attaching portion of the lid of the vessel shown in FIG. 1.

Referring to FIGS. 1 and 2 showing the state where the easily-openable heat-seal lid of the present invention is applied to a vessel and FIG. 3 which is an enlarged sectional view showing the main portion of the lid, this easily-openable heat-seal lid 1 is composed of a lid member comprising a inner surface member 2 of a heat-sealable thermoplastic resin and a metal foil 3, and a protecting resin layer 4 is formed on the outer surface of the lid member 1 to protect the metal foil.

The lid member 1 has a peripheral portion 5 to be heat-sealed, and a curl 6 is formed on the outermost edge of the peripheral portion 5. A score 8 defining a portion 7 to be opened (see FIG. 2) is formed at a part of the lid more central than the peripheral portion 5 for heat sealing. An opening tab 9 for opening the seal is formed on the portion 7 to be opened in a manner described in detail hereinafter.

As shown in FIG. 1, a vessel 10 to which this heat-seal lid is applied is formed of a thermoplastic resin film or sheet or a laminate thereof with a paper substrate and/or a metal foil, and the vessel 10 comprises a bottom 11, a side wall 12 connected integrally thereto and a flange 13 connected to the open end of the side wall 12. Sealing is accomplished between this flange 13 and the peripheral portion 5 of the lid member by heat sealing.

Figure 4:
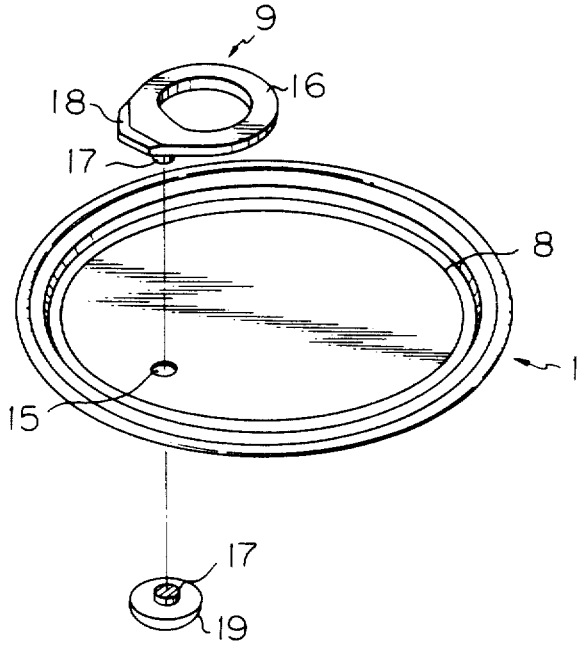
FIG. 4 is a fragmentary perspective view of the lid of the vessel shown in FIG. 1.

As shown in the enlarged view of FIG. 3, in the prsent invention, the score 8 is formed so that it extends to the midway of the metal foil 3 from the outer side, and a hole 15 piercing through the lid member 1 is formed on the inner side of the score 8 in the vicinity of an opening-initiating portion 14 of the score. The opening tab 9 comprises an opening ring 16 and a rivet 17, and the opening ring 16 has a push-tearing top end 18 on one end thereof. The rivet 17 is composed of the inner surface member 2 of the lid 1 and a heat-sealable thermoplastic resin. As shown in FIG. 4, this rivet 17 is inserted in the through hole 15 of the lid member 1 and the top end portion 19 of the rivet 17 projected on the inner surface side is expanded in the horizontal plane direction to secure the tab 9 to the lid member. The top end portion 19 of the rivet 17 projected to the inner surface side is sealed and engaged with the inner surface member 2 of the lid member by heat fusion bonding.

As shown in FIG. 2, one end portion of the opening tab 9, that is, the push-tearing top end 18, is substantially superimposed on the opening-initiating portion 14 of the score of the lid member 1. In the embodiment illustrated in FIGS. 1 through 4, the opening ring 16 and rivet 17 are integrally formed of a heat-sealable resin.

In the heat-seal lid of the present invention, it is preferred that the area ratio So/S1 of the sectional area So of the through hole 15, that is, the sectional area of the rivet 17, to the seal area S1 between the top end portion 19 of the rivet and the inner surface member 2, be in the range of from 20/1 to 1/20, especially from 5/1 to 1/10.

In order to effect opening by tearing the laminate comprising a metal foil and a resin film, it is first of all important to form a break in the opening-initiating portion 14 of the score 8. Once a break is formed on the score 8, tearing of the laminate is advanced relatively easily along the score 8. A sharp and large shearing force is necessary for forming a break on the score 8 for opening the seal, and a strong fulcrum is necessary for producing such a shearing force.

According to the present invention, the through hole 15 is formed in the vicinity of the opening-initiating portion 14, the rivet 17 of the opening tab 9 is inserted in the through hole 15, and the top end portion 18 of the rivet 17 is expanded and the tab is secured by heat fusion bonding. Therefore, a fulcrum for opening the seal, which is much stronger than the fulcrum formed by heat-bonding the opening tab 9 to the lid, is formed according to the present invention. In the lid of the present invention, when the ring 16 of the tab 9 is pulled up, the top end of the tab 9 is pushed into the opening-initiating portion 14 of the score and a break is easily formed on the score by shearing. Namely, the expanded top end portion 18 of the rivet exerts a function of preventing excessive deformation of the portion to act as the fulcrum even if the lid member is flexible and relatively soft.

Another important problem of the above-mentioned type easily-openable lid is that it is difficult to form a heat seal having a reliability enough to resist retort sterilization, hot filling or other storage conditions between the through hole 15 formed in the lid member and the rivet 17 of the opening tab and it also is difficult to perform the opening operation smoothly because the opening tab falls out from the through hole 15 or tearing is caused from the through hole 15 at the seal-opening step.

In the present invention, the inwardly projected top end portion 19 of the rivet 17 inserted in the through hole 17 is expanded in the horizontal plane direction, this portion 19 is heat-fusion-bonded to the inner surface member 2 of the lid, and the ratio of the sectional area So of the through hole 15 to the sectional area S1 of the heat seal portion (top end portion 19) is adjusted within the above-mentioned range, whereby the above-mentioned problem is effectively solved. If the area ratio of the heat seal portion is too small and below the above-mentioned range, shifting or falling of the opening tab or insufficient sealing is readily caused, and if the area ratio of the heat seal portion is too large and exceeds the above range, it is difficult to effectively push the push-tearing top end portion 18 into the opening-initiating portion 14 of the score 18, and the easy openability is degraded. According to the present invention, by adjusting the area ratio of the heat seal portion within the above-mentioned range, a good seal reliability, a good fixation of the tab and a good easy openability can be attained in combination.

In the present invention, in order to effectively secure the opening tab, it is preferred that the sectional area of the through hole 15 formed in the lid member 1 be 2 to 100 $mm^2$, especially 4 to 30 $mm^2$.

The kind of the laminate sheet used for the lid of the present invention is not particularly critical so far as it comprises a heat-sealable inner surface member 2 and a metal foil 3. In the present invention, a laminate in which the heat-sealable inner surface member 2 is bonded to the surface, to be formed into an inner surface of the package, of the metal foil 3 through an adhesive layer 20 and a protective coating 4 is formed on the other surface of the metal foil 3 is advantageously used.

As the metal foil 3, a foil of a light metal such as an aluminum foil is used in the present invention. Of course, an iron foil, a steel foil and a tinplate foil can also be used. From the viewpoint of the resistance to heat sterilization, it is preferred that a surface treatment layer 21 be formed on the metal foil by an alumite treatment, a boehmite treatment, a chemical treatment with phosphate and/or chromate, a forming treatment or a similar preliminary treatment.

In order to enable tearing along the score, it is necessary that the metal foil should have a certain rigidity. Accordingly, it is preferred that the thickness of the metal foil be at least 50 microns, especially at least 80 microns. In order to prevent the fingers or the like from being hurt at the seal-opening step and from the economical viewpoint, it is preferred that the thickness of the metal foil be up to 200 microns, especially up to 150 microns.

From the viewpoint of the gas barrier property and also from the viewpoint of the pressure resistance or falling shock resistance, it is important that the score 8 should be extended only to the midway of the metal foil in the thickness direction thereof. In view of the foregoing properties and the easy openability, it is preferred that the depth of the score 8 be 3/10 to 7/10, especially 2/5 to 3/5, of the entire thickness of the metal foil and the remaining thickness of the score-formed portion of the metal foil be at least 20 microns, especially at least 30 microns.

A propylene type resin, especially isotactic polypropylene, is preferred as the material of the heat-sealable inner surface member 2. A crystalline propylene-ethylene copolymer having an ethylene content of up to 15 mole %, especially up to 10 mole %, can also be used. It is preferred that the melt index of the polypropylene resin be 5 to 100 g/10 min (ASTM D-1238). If the thickness of the propylene type resin film is too large, tearing of the laminate along the score becomes difficult, and if the thickness is too small, the heat-sealability is reduced. Accordingly, it is preferred that the thickness of the heat-sealable inner surface member be 30 to 150 microns, especially 50 to 100 microns.

An acid-modified propylene resin is most preferred as the adhesive 20 for the heat-sealable inner surface member, and the propylene type resin layer is heat-fusion-bonded to the metal foil 3 through the acid-modified propylene resin.

In the present invention, if a propylene type resin is selected as the heat-sealable inner surface member and this inner surface member is heat-fusion-bonded to the metal foil through an acid- or acid anhydride-modified olefin resin having propylene units as main olefin units (hereinafter referred to as "acid-modified propylene resin"), the laminate sheet can be torn along the score more precisely and more smoothly than in the case of any other combination.

If the propylene type resin film is heat-fusion-bonded to the metal foil through the acid-modified propylene resin layer, delamination of the laminate, that is, interlaminar peeling of the laminate, is prevented at shearing of the laminate more effectively than in the case where any other adhesive layer is used for bonding the propylene type resin film to the metal foil.

The propylene type resin used in this embodiment of the present invention has a relatively small elongation and has a chemical structure characterized in that tertiary carbon atoms are present alternately in the polymer chain. Accordingly, the propylene type resin is likely to undergo thermal degradation. Furthermore, this propylene type polymer is characterized in that crystallization is readily advanced at high temperatures.

If the propylene type resin film is heat-fusion-bonded to the metal foil through the acid-modified propylene resin layer, since the acid-modified propylene resin has carboxyl groups having a high affinity with the metal foil and contains the same main constituent olefin units as those of the propylene type resin, a strong interlaminar bonding capable of resisting retort sterilization or peeling can be obtained, and furthermore, the elongation of the film per se is reduced by degradation or crystallization of the propylene type resin film caused at the heat fusion bonding step and the laminate can be torn along the score precisely and smoothly.

A preferred acid-modified propylene resin contains a carboxyl group or its anhydride at a concentration of 1 to 600 meq/100 g of the polymer, especially 10 to 300 meq/100 g of the polymer. In view of the easy openability or heat bondability, it is preferred that the melt index of the modified propylene resin be at least 5 g/10 min.

At least one member selected from (A) ethylenically unsaturated carboxylic acids such as acrylic acid, methacrylic acid, maleic acid, fumaric acid, crotonic acid, itaconic acid, citraconic acid and 5-norbornene-2,3-dicarboxylic acid and (B) ethylenically unsaturated carboxylic acid anhydrides such as maleic anhydride, citraconic anhydride, 5-norbornene-2,3-dicarboxylic anhydride and tetrahydrophthalic anhydride is used for modification. A maleic anhydride-modified polypropylene is especially preferred for attaining the objects of the present invention.

The modifying treatment is accomplished by introducing the monomer into the main or side chain of the propylene type resin by known means such as graft copolymerization or terminal treatment. For example, a modified propylene resin can easily be obtained by contacting a trunk polymer composed of a propylene type resin with an acid group-containing ethylenically unsaturated monomer in the presence of a radical initiator. Ordinarily, the modified propylene resin is interposed in a thickness of 0.5 to 20 microns, especially 1 to 10 microns, between the metal foil and the propylene type resin.

At the heat fusion bonding step, the modified propylene resin is coated on the metal foil in the form of a film, powder, dispersion or solution and is then melted by heating, and a preformed film of the propylene type resin is piled on the melt and fusion-bonded to the metal foil. Coating of the modified propylene resin can be accomplished by electrostatic coating, roll coating, dip coating, bar coating, flame spray coating fluidized dipping or extrusion coating. Heating of the coated metal foil is accomplished by high frequency induction heating, infra red ray heating, hot air furnace heating or the like. Instead of the method in which the modified propylene resin and the propylene type resin are independently applied to the metal foil, there may be adopted a method in which both the resins are coextruded through a multi-layer multi-ply die and the co-extruded two-layer film is heat-fusion-bonded to the metal foil.

As the inner surface member 2, there may also be used low-density polyethylene, medium-density polyethylene, high-density polyethylene, an ethylene-vinyl acetate copolymer, an ethylene-butene-1 copolymer, an ethylene-propylene copolymer and other olefin type resins. In this case, a corresponding acid-modified olefin resin is used as the adhesive layer 20. A urethane type adhesive or other adhesive may be used as the adhesive layer 20 instead of the acid-modified resin.

Instead of the method in which the inner surface member 2 is bonded to the metal foil 3 through the adhesive layer 20, there may be adopted a method in which a thermoplastic resin having a heat sealablity and being capable of being heat-fusion-bonded to the metal foil, such as a thermoplastic polyester or copolyester, a homopolyamide or copolyamide or an acid-modified olefin resin is directly bonded as the inner surface member to the metal foil.

For formation of the protective coating 4, there may be used optional paints composed of thermosetting or thermoplastic resins, for example, modified epoxy paints such as a phenol-epoxy paint and an amino-epoxy paint, vinyl and modified vinyl paints such as a vinyl chloride-vinyl acetate copolymer paint, a partially saponified vinyl chloride-vinyl acetate copolymer paint, a vinyl chloride-vinyl acetate-maleic anhydride copolymer paint and an epoxy-, epoxyamino- or epoxyphenol-modified vinyl paint, acrylic resin paints, and synthetic rubber type paints such as a styrene-butadiene copolymer paint. Furthermore, a nitrocellulose type varnish can be used effectively.

The paint is applied to the metal foil in the form of an organic solvent solution or organosol such as an enamel or lacquer or an aqueous dispersion or solution by spray coating, roll coating, dip coating, electrostatic coating or electrophoretic deposition. If a thermosetting paint is used, baking is carried out according to need. Of course, a resin film or coating may be used instead of the paint as the protecting coating 4.

The opening tab 9 is formed on the inner surface member 2 by injection molding or the like means of a heat-sealable resin. Thermal deformation of top end of the rivet 17 or fusion bonding of the top end of the rivet 17 to the inner surface member can easily be accomplished by pressing under heating by ultrasonic wave irradiation, radiant heat or heat conduction or by press forming. In order to obtain a more complete heat seal between the lid member and the opening tab, there may be adopted a method in which high frequency induction heating is carried out by using the electric conductivity of the metal foil 2.

In the present invention, the shape of the score 8 may be a so-called full-open shape in which the entire inner side of the seal portion is opened. Furthermore, a score 8*a* of a small circular shape or rain drop-like shape is formed only on the inner side of the seal portion to define a portion to be opened as a pouring opening.

Figure 6:
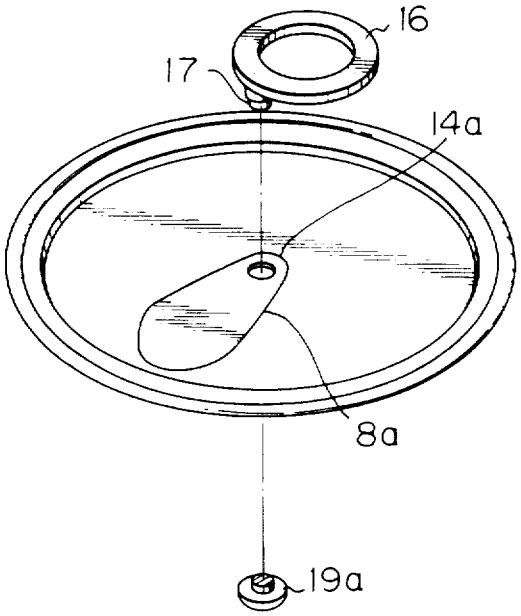
FIG. 6 is a fragmentary perspective view illustrating a lid according to still another embodiment of the present invention.
Figure 7:
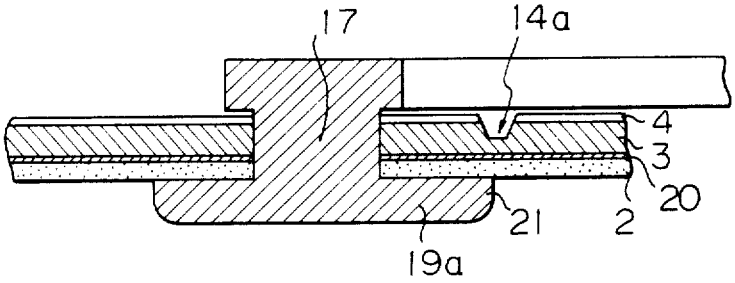
FIG. 7 is an enlarged sectional view of a tab-attaching portion of the lid shown in FIG. 6.

Moreover, instead of the method in which the push-tearing end is formed on one end of the opening ring 16, there may be adopted a method in which, as shown in FIGS. 6 and 7, the edge 21 of the expanded top end portion 19*a* of the rivet 17 is superimposed on the opening-initiating portion 14*a* of the score 8*a* so that when the ring 16 is pulled up, a break is formed on the opening-initiating portion 14 of the score 8*a* by tearing. In this case, it is important that the edge 21 of the expanded top end portion 19*a* of the rivet 17 should be substantially superimposed on the opening-initiating portion 14*a* of the score. If the opening-initiating portion 14*a* of the score is distant from the edge 21, a large force becomes necessary for initiating opening or it becomes impossible to effect opening. If the area ratio between the sectional area So of the through hole 15 and the sectional area S1 of the heat seal portion (the top end portion 19*a*) is below the above-mentioned range, as in the embodiment shown in FIGS. 1 through 4, insufficient sealing or shifting or falling of the opening tab is caused, and if the area ratio of the heat seal portion is too large and exceeds the above-mentioned range, effective tearing of the opening-initiating portion 14*a* of the score by the edge 21 of the heat seal portion becomes difficult.

Also in the case where the edge 21 of the heat seal portion is bonded even to the outside beyond the score line 14*a*, tearing of the score cannot easily be accomplished, and the force for initiating opening is increased and it is often impossible to initiate opening.

Figure 8:
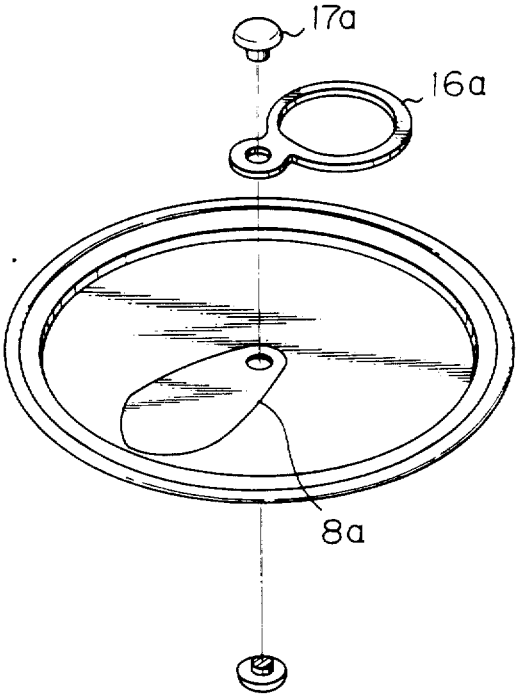
FIG. 8 is a fragmentary perspective view illustrating a lid according to still another embodiment of the present invention.

Instead of the method in which the opening ring and rivet are integrally formed from the resin, there may be a method in which, as shown in FIG. 8, only the rivet 17*a* is formed from the resin and the opening ring 16*a* is formed from aluminum, tinplate, tin-free steel or other optinal metal material by punching and bending, and the ring 16*a* is secured by the rivet 17*a*.

Figure 11:
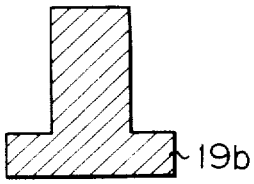
FIG. 11 is a sectional view of a rivet portion of a lid according to still another embodiment of the present invention.
Figure 12:
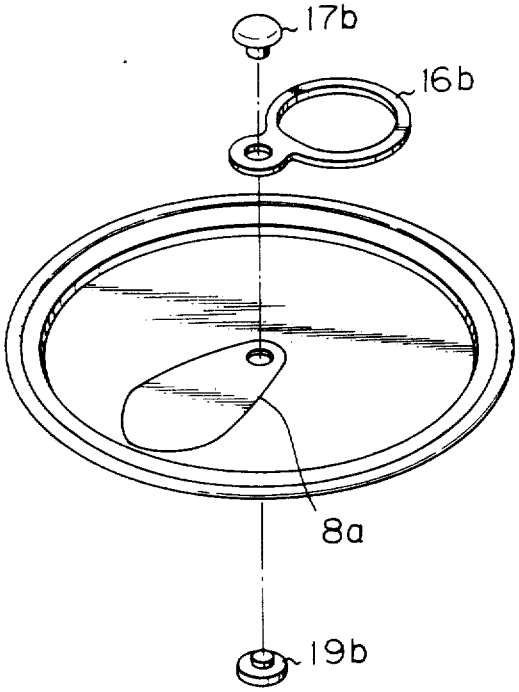
FIG. 12 is a fragmentary perspective view illustrating a lid including the rivet shown in FIG. 11.

Moreover, there may be adopted a method in which, as shown in FIG. 11, a rivet having a portion 19*b* projected to the inner surface side is used, the portion 19*b* is inserted into a small hole of the lid panel from the inner surface side and fusion-bonded to the inner surface of the panel by high frequency inducting heating, a plastic ring 16*b* as shown in FIG. 12 is inserted into the rivet, and an upper portion 17*b* of the rivet is formed as the head by ultrasonic forming or hot anvil forming and is secured to the plastic ring 16*b*.

The lid of the present invention may be advantageously applied to various vessels such as a metal can, a plastic vessel, a metal foil vessel, a metal foil/plastic material composite vessel, a paper/plastic material composite vessel and a paper/metal foil/plastic material composite vessel, and the lid of the present invention can be especially applied to an easily buckling vessel to which double seaming is not applicable or for sealing a packaging vessel which should be sujbected to hot filling and heat sterilization. Moreover, the lid of the present invention is preferably used as a heat seal lid for a plastic cup obtained by vacuum forming, a monoaxially or biaxially drawn plastic cup obtained by plug-assist forming or air-pressure forming, a metal foil vessel obtained by draw forming and a side seam vessel composed of a flexible material.

In the vessel lid of the present invention, since the portion to be opened is formed independently form the heat seal portion, it is possible to render the heat seal portion capable of resisting hot filling or sterilization such as hot water sterilization or retort sterilization, and hence, the sealing reliability can be enhanced and a food or the like can be stored stably for a long time. Furthermore, opening can be accomplished very easily and assuredly.

The excellent effects attained by the present invention will now be described with reference to the following Examples that by no means limit the scope of the invention.

EXAMPLES 1 THROUGH 3

By using materials shown in Table 1, a laminate sheet having a structure of outer layer/aluminum foil/adhesive layer/inner surface layer was prepared by the powder coat lamination method (Example 1), the extrusion coat lamination method (Example 2) or the dry lamination method (Example 3).

An intermediate product for a lid, which had a shape of a trap-lid as shown in FIG. 6 and a diameter of 60 mm and in which a liquid pore type score was formed and a small hole having a diameter shown in Table 1 was formed in the central portion by punching was prepared from the laminate sheet.

An opening tab having integrated opening ring and rivet as shown in FIG. 6 was prepared from a material shown in Table 1 by injection molding.

The rivet portion of the opening tab was inserted into the small hole formed in the central portion of the intermediate product for a lid and the head of the rivet was formed as 19*a* shown in FIGS. 6 and 7 according to a method indicated in Table 1.

A bottom lid which was not scored and to which a tab was not attached was sealed by a high frequency sealer to a curl portion of one opening of a convolute can body having a diameter of 55 mm and a height of 132 mm and having both the ends curled, which was composed of a laminate of polyethylene/paper/polypropylene/aluminum foil/polypropylene (Examples 1 and 3) or polyethylene/paper/polyethylene/aluminum foil/polyethylene (Example 2). The so-formed vessel proper was filled with orange juice heated at 80° C., and the opening ring-attached lid prepared at the preceding step was sealed to the curl portion of the other opening of the can body by a high frequency sealer.

In each vessel, if opening was tried in the opening portion of the lid by using the ring of the tab, opening could be performed smoothly along the predetermined score line. None of such defects as delamination feathering were observed in the opening portion after the opening operation.

COMPARATIVE EXAMPLE 1

A lid was prepared in the same manner as described in Example 1 except that the diameter of the through hole formed in the central portion of the lid was changed to 5 mm and the diameter of the bonded portion on the inner surface layer side of the rivet was changed to 5.1 mm (So/S1=24.8/1). The content was filled in the vessel, and when opening was tried, the opening ring tab was popped off from the small hole and opening laong the score was impossible.

COMPARATIVE EXAMPLE 2

A lid was prepared in the same manner as described in Example 1 except that the diameter of the through hole formed in the central portion of the lid was changed to 2 mm and the diameter of the bonded portion on the inner surface layer side of the rivet was changed to 10 mm (So/S1=1/24.3). The content was filled in the vessel, and when opening by the ring tab was tried, the force necessary for initiating opening was large and the ring-attached portion of the rivet was torn, and opening was impossible.

EXAMPLES 4 AND 5

By using materials shown in Table 2, a laminate sheet having a structure of outer layer/aluminum foil/adhesive layer/inner surface layer was prepared by extrusion coat lamination (Example 4) or dry lamination (Example 5).

Figure 5:
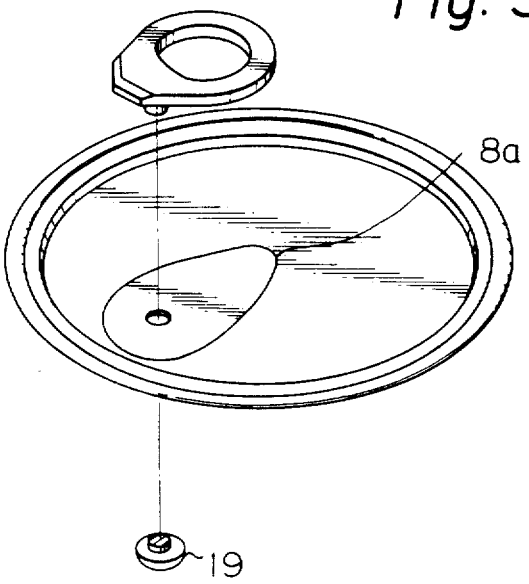
FIG. 5 is a fragmentary perspective view illustrating a lid according to another embodiment of the present invention.

An intermediate product for a lid, which had a trap-lid shape as shown in FIGS. 1 through 4 (Example 4) or FIG. 5 (Example 5) and in which a score was formed and a small hole having a diameter shown in Table 2 was formed by punching was prepared from the laminate sheet.

The rivet of the opening tab was inserted into the small hole of the intermediate product for a lid, and the head of the rivet was formed as 19 in FIGS. 4 and 5 according to the method shown in Table 2 and fusion-bonded to the inner surface resin layer.

In Example 4, a cup formed of polypropylene, which comprised a bottom having a diameter of 50 mm, a tapered side wall having a height of 80 mm and a flange having a diameter of 74 mm and a width of 3 mm was filled with fruit yogurt, and the lid prepared above was sealed to the flange of the cup by a heat sealer.

In Example 5, a paper composite can body as used in Example 2 was filled with orange juice heated at 80° C., and the lid prepared above was sealed to the curled portion of the opening of the can body by a high frequency sealer.

In each of the filled vessels, when opening was tried by using the ring tab, opening could be performed along the predetermined score line smoothly, and none of such defects as delamination and feathering were observed in the opening.

COMPARATIVE EXAMPLE 3

The procedures of Example 1 were repeated in the same manner except that the opening tab was not attached in the vicinity of the score but at the central part of the portion defined by the score. Since the peripheral edge on the bonded portion on the inner surface side of the head of the rivet was not substantially superimposed on the opening-initiating portion of the score, even if opening was tried by pulling up the opening ring, no break was formed on the opening-initiating portion of the score and opening was impossible.

COMPARATIVE EXAMPLE 4

The procedures of Example 4 were repeated in the same manner except that the opening tab was not attached in the vicinity of the score but at a part close to the center of the portion defined by the score. Since one end portion of the opening tab was not substantially superimposed on the opening-initiating portion of the score, even if opening was tried, no break was formed on the opening-initiating portion of the score by the push-tearing top end of the opening tab, and it was impossible to effect opening smoothly along the score.

EXAMPLE 6

By using materials shown in Table 3, a laminate sheet having a structure of coating paint layer/120-μ aluminum foil/10-μ maleic anhydride-modified high density polyethylene layer/60-μ high density polyethylene layer was prepared by extrusion coat lamination.

Figure 9:
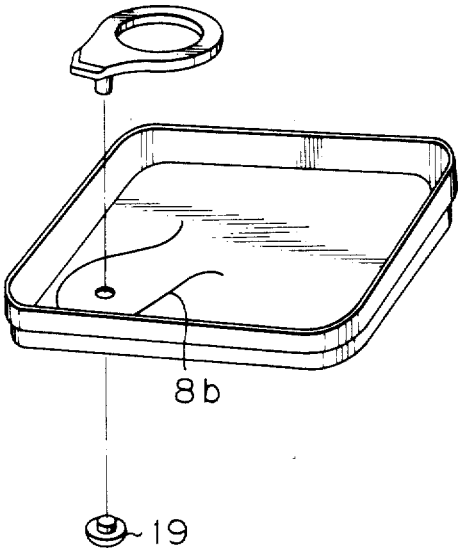
FIG. 9 is a fragmentary perspective view illustrating a lid according to still another embodiment of the present invention.

A square intermediate product for a lid, in which a non-detach liquid pore type score was formed as shown in FIG. 9 and a small hole having a diameter shown in Table 3 was formed by punching, was prepared from the laminate sheet. A rivet portion of a reverse type opening tab was inserted into the small hole of the intermediate product for a lid, and the head of the rivet was formed as 19 in FIG. 9 according to the method shown in Table 3 and fusion-bonded to the inner surface resin.

A square can body having a size of 60 mm×60 mm×210 mm (height) was prepared from the same laminate of polyethylene/paper/polyethylene/aluminum foil/polyethylene as used in Example 2. A bottom lid in which a score was not formed, a small hole was not formed and a tab was not attached was sealed to one open end of the can body by a high frequency sealer. The vessel was filled with orange juice heated at 80° C., and the tab-attached lid obtained at the preceding step was sealed to the other open end of the can body by a high frequency sealer.

When opening was tried in the opening of the sealed vessel filled with the content by using the ring tab, opening could be performed smoothly along the predetermined score line. None of such defects as delamination and feathering were observed in the opening after the opening operation.

EXAMPLE 7

By using materials shown in Table 3, a laminate sheet having a structure of coating paint layer/100-μ aluminum foil/10-μ maleic anhydride-modified polypropylene/50-μ ethylene-propylene copolymer was prepared by extrusion coat lamination.

Figure 10:
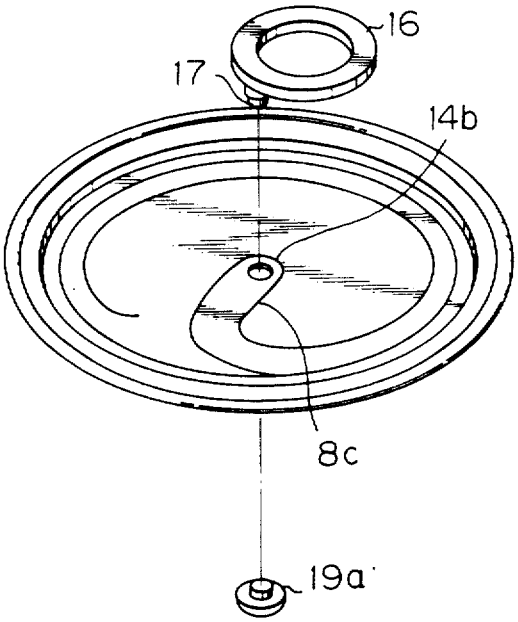
FIG. 10 is a fragmentary perspective view illustrating a lid according to still another embodiment of the present invention.

An intermediate product for a lid having a trap-lid shape, in which a volute full-open type score as shown in FIG. 10 was formed and a small hole having a diameter shown in Table 3 was formed, was prepared from the laminate sheet. The rivet portion of the opening tab was inserted into the small hole of the intermediate product, and the head of the rivet was formed as 19*a* in FIG. 10 according to the method shown in Table 3 and fusion-bonded to the inner surface resin layer.

A cup as used in Example 4 was filled with wine jelly, and the so-prepared lid was heat-sealed to the flange of the cup. When the sealed vessel was subjected to the opening test, opening could be performed very smoothly in good conditions and no problem arose.

TABLE 1

| | Example 1 | Example 2 | Example 3 |
|---|---|---|---|
| Outer layer | epoxy-phenol paint | epoxy-phenol paint | nitrocellulose type coating material |
| Metal foil | aluminum foil (100μ) | aluminum foil (100μ) | aluminum foil (100μ) |
| Adhesive layer | maleic anhydride-modified polypropylene (2μ) | maleic anhydride-modified high density polyethylene (10μ) | urethane type adhesive (3μ) |
| Inner surface resin layer | ethylene-propylene copolymer (50μ) | low density polyethylene (50μ) | homopolypropylene (50μ) |
| Lamination method | powder coat lamination | extrusion coat lamination | dry lamination |
| Shape of score | liquid pore type | liquid pore type | liquid pore type |
| Residual thickness in score | 40μ | 30μ | 30μ |
| Shape of lid | 60 mm in diameter, trap-lid, no curl | 60 mm in diameter, trap-lid, no curl | 60 mm in diameter, trap-lid, no curl |
| Diameter of through hole | 3 mm | 3.5 mm | 4 mm |
| Material of tab | polypropylene | high density polyethylene | polypropylene |
| Diameter of bonded portion on inner surface layer side of rivet | 5 mm | 5 mm | 7 mm |
| So/Sl | 1/1.79 | 1/1.04 | 1/2.06 |
| Tab bonding method | ultrasonic riveting and subsequent high frequency heating | hot press forming and subsequent high frequency heating | forming by hot anvil and bonding |

TABLE 2

| | Example 4 | Example 5 |
|---|---|---|
| Outer layer | epoxy-phenol paint | nitrocellulose type coating material |
| Metal foil | aluminum foil (100μ) | aluminum foil (80μ) |
| Adhesive layer | maleic anhydride-modified polypropylene (10μ) | urethane adhesive (3μ) |
| Inner surface resin layer | ethylene-propylene copolymer (50μ) | talc-filled high density polyethylene (50μ) |
| Lamination method | extrusion coat lamination | dry lamination |
| Shape of score | full open type | liquid pore type |
| Residual thickness in score | 50μ | 30μ |
| Shape of lid | 74 mm in diameter, trap-lid, no curl | 60 mm in diameter, trap-lid, no curl |
| Diameter of through hole | 4 mm | 3 mm |
| Material of tab | polypropylene (provided with tearing top end) | high density polyethylene (provided with tearing top end) |
| Diameter of bonded portion on inner surface | 8 mm | 5 mm |

TABLE 2-continued

| | Example 4 | Example 5 |
|---|---|---|
| layer side of rivet | | |
| So/Sl | 1/3.00 | 1/1.78 |
| Tab bonding method | hot press forming and subsequent high frequency heating | ultrasonic riveting |

TABLE 3

| | Example 6 | Example 7 |
|---|---|---|
| Outer layer | epoxy-urea paint | epoxy-phenol paint |
| Metal foil | aluminum foil (120μ) | aluminum foil (100μ) |
| Adhesive layer | maleic anhydride-modified high density polyethylene (10μ) | maleic anhydride-modified polypropylene (10μ) |
| Inner surface resin layer | high density polyethylene (60μ) | ethylene-propylene copolymer (50μ) |
| Lamination method | extrusion coat lamination | extrusion coat lamination |
| Shape of score | non-detach liquid pore type | volute full open type |
| Residual thickness in score | 50μ | 50μ |
| Shape of lid | square (60 mm × 60 mm) | 74 mm in diameter, trap-lid, no curl |
| Diameter of through hole | 3.5 mm | 3.5 mm |
| Material of tab | high density polyethylene | polypropylene |
| Diameter of bonded portion on inner surface layer side of rivet | 5 mm | 6.5 mm |
| So/Sl | 1/1.04 | 1/2.50 |
| Tab bonding method | hot press forming and subsequent high frequency heating | hot press forming and subsequent high frequency heating |

We claim:

1. An easily-openable heat-seal lid for forming a heat-sealed portion with a vessel proper for sealing the vessel proper, which is composed of a laminate comprising at least an inner surface member of a heat-sealable resin, a metal foil and an outer protecting layer, wherein a score defining a portion to be opened is formed at a part of the lid more central than the peripheral portion to be heat-sealed so that the score extends to the midway of the metal foil in the thickness direction from the outer side, a through hole piercing through the lid is formed on the inner side of the score in the vicinity of the opening-initiating portion of the score, a rivet of an opening tab, which is composed of the inner surface member material and a heat-sealable resin, is inserted through the hole to project to the inner surface side of the lid, the top end portion of said projection of the rivet is expanded in the plane direction to secure the opening tab, the top end portion of the rivet projected on the inner surface side is sealed and engaged with the inner surface member by heat fusion bonding, and one end portion of the opening tab or the peripheral portion of the inner surface side of the rivet is substantially superimposed on the opening-initiating portion of the score.

2. An easily-openable heat-seal lid as set forth in claim 1, wherein the ratio of the sectional area of the through hole to the seal area between the rivet and the inner surface member is within the range of from 20/1 to 1/20.

3. An easily-openable heat-seal lid as set forth in claim 2, wherein said area ratio is within the range of from 5/1 to 1/10.

4. An easily-openable heat-seal lid as set forth in claim 1, wherein the sectional area of the through hole is 2 to 100 $mm^2$.

5. An easily-openable heat-seal lid as set forth in claim 1, wherein the thickness of the metal foil is 50 to 200 microns.

6. An easily-openable heat-seal lid as set forth in claim 1, wherein the depth of the score is 3/10 to 7/10 of the entire thickness of the metal foil and the remaining thickness of the metal foil in the score is at least 20 microns.

7. An easily-openable heat-seal lid as set forth in claim 1, wherein the heat-sealable inner surface member is composed of isotactic polypropylene or a crystalline propylene-ethylene copolymer having an ethylene content lower than 10 mole %.

8. An easily-openable heat-seal lid as set forth in claim 7, wherein the thickness of the inner surface member is 30 to 150 microns.

9. An easily-openable heat-seal lid as set forth in claim 7, wherein the inner surface member is heat-fusion-bonded to the metal foil through an adhesive layer composed of an acid- or acid anhydride-modified propylene resin.

* * * * *